US012185769B2

(12) United States Patent
Brito et al.

(10) Patent No.: US 12,185,769 B2
(45) Date of Patent: Jan. 7, 2025

(54) ADJUSTABLE GARMENT DEVICE

(71) Applicant: InQube Solutions (Private) Limited, South Ranala (LK)

(72) Inventors: Welandagothrige Rakitha Brito, Rajagiriya (LK); Nagahagedara Sanjaya Roshana Helan, Ganemulla (LK); Hettikankanamge Druvi Arjuna Hettikankanm, Panadura (LK)

(73) Assignee: Inqube Solutions (Private) Limited, Ranala (LK)

( * ) Notice: Subject to any disclaimer, the term of this patent is extended or adjusted under 35 U.S.C. 154(b) by 40 days.

(21) Appl. No.: 17/756,821

(22) PCT Filed: Dec. 7, 2020

(86) PCT No.: PCT/IB2020/061607

§ 371 (c)(1),
(2) Date: Jun. 3, 2022

(87) PCT Pub. No.: WO2021/111428

PCT Pub. Date: Jun. 10, 2021

(65) Prior Publication Data

US 2023/0022543 A1 Jan. 26, 2023

Related U.S. Application Data

(60) Provisional application No. 62/943,983, filed on Dec. 5, 2019.

(51) Int. Cl.
*A41C 3/00* (2006.01)

(52) U.S. Cl.
CPC ..... *A41C 3/0028* (2013.01); *A41C 3/0021* (2013.01)

(58) Field of Classification Search
CPC ..... A41C 3/0028; A41C 3/002
(Continued)

(56) References Cited

U.S. PATENT DOCUMENTS 5,971,934 A 10/1999 Murrary
8,282,441 B2 10/2012 Mays
(Continued)

FOREIGN PATENT DOCUMENTS

CN 109007995 A 12/2018
KR 20-0390166 Y1 7/2005
WO WO 2012/0141768 A2 10/2012

OTHER PUBLICATIONS

International Search Report and Written Opinion for PCT/IB2020/061607 (ISA/KR) mailed Mar. 11, 2021 (7 pages).
(Continued)

*Primary Examiner* — Timothy K Trieu
(74) *Attorney, Agent, or Firm* — Alston & Bird LLP

(57) ABSTRACT

An adjustable bra and method of adjusting the same are provided. The adjustable bra includes a bra garment with a plurality of garment adjusters. Each garment adjuster is configured to adjust at least one adjustable bra feature relating to at least one of the fit or support of the bra garment. The adjustable bra also includes an adjustment mechanism configured with a plurality of adjustment positions. The adjustment mechanism is movable between a plurality of positions corresponding to the garment adjuster position of each garment feature and the adjustment mechanism also includes a singular adjustment point configured to move the garment adjusters between different positions. A corresponding method of adjusting the adjustable bra is also provided.

20 Claims, 10 Drawing Sheets

(58) Field of Classification Search
USPC ..... 450/77
See application file for complete search history.

(56) References Cited

U.S. PATENT DOCUMENTS

| | | | | |
|---|---|---|---|---|
| 2007/0264905 | A1 | 11/2007 | Horta et al. | |
| 2012/0167290 | A1* | 7/2012 | Kovacevich | F16G 11/14 2/463 |
| 2012/0302135 | A1 | 11/2012 | Solotoff | |
| 2013/0203319 | A1* | 8/2013 | Torres | A41C 3/0028 450/59 |
| 2014/0259301 | A1* | 9/2014 | Berns | A43C 9/00 2/336 |
| 2021/0030081 | A1* | 2/2021 | Cummiskey | A41D 13/0518 |

OTHER PUBLICATIONS

International Preliminary Report on Patentability for PCT/IB2020/061607 (IPEA/KR) mailed Apr. 6, 2022 (6 pages).
Office Action for Canadian Patent Application No. 3,163,671 dated Jan. 5, 2024 (6 pages).
Extended European Search Report for EP Application No. 20896806.5 dated Nov. 28, 2023 (7 pages).

* cited by examiner

300

ADJUSTABLE GARMENT DEVICE

CROSS REFERENCE TO RELATED APPLICATIONS

This application is a National Stage Application, filed under 35 U.S.C. § 371, of International Application No. PCT/IB2020/061607, filed Dec. 7, 2020 which claims priority to U.S. Provisional Application No. 62/943,983, filed Dec. 5, 2019; the contents of both of which are hereby incorporated by reference in their entirety.

TECHNOLOGICAL FIELD

An example embodiment relates generally to adjustable clothing, and more particularly, example embodiments relate to providing easy to use adjustment means for clothing, such as bras.

BACKGROUND

Traditional bra garments offer minimal adjusting means and thus make it difficult to generate an ideal fit for a user. As a result, many people are wearing the wrong bra size without any options of getting a better fit. Through applied effort, ingenuity, and innovation, many of these identified problems have been solved by developing solutions that are included in embodiments of the present disclosure, many examples of which are described in detail herein.

BRIEF SUMMARY

The following presents a simplified summary in order to provide a basic understanding of some aspects of the present disclosure. This summary is not an extensive overview and is intended to neither identify key or critical elements nor delineate the scope of such elements. Its purpose is to present some concepts of the described features in a simplified form as a prelude to the more detailed description that is presented later.

In an example embodiment, an adjustable bra is provided. The adjustable bra includes a bra garment with a plurality of garment adjusters. Each garment adjuster is configured to adjust at least one adjustable bra feature relating to the fit and/or the support of the bra garment. The adjustable bra also includes an adjustment mechanism configured with a plurality of adjustment positions. The adjustment mechanism is movable between a plurality of positions corresponding to the garment adjuster position of each garment feature and the adjustment mechanism also includes a singular adjustment point configured to move the garment adjusters between different positions.

In some embodiments, the adjustable bra also includes an adjustment motor configured to move at least two features of the garment into the specific setting based on the adjustment position of the adjustment mechanism. In some embodiments, the adjustment mechanism is activated by at least one of voice, touch, and/or mobile device. In some embodiments, the adjustment mechanism includes a knob configured to adjust at least two of the garment adjusters.

In some embodiments, the plurality of garment adjusters includes a cable mechanism inside the bra garment in communication with the adjustment mechanism. In some embodiments, the at least one adjustable bra feature includes at least one of the waistband, the back straps, or the cup. In some embodiments, the bra garment is adjustable in an instance in which the bra garment is worn. In some embodiments, each adjustment position of the adjustment mechanism corresponds to a different activity for which the adjustable bra is used. In some embodiments, the bra garment also includes a plurality of layers and the cable mechanism is housed between at least two of the plurality of layers. In some embodiments, the cable mechanism is housed within a single layer of the bra garment.

In another example embodiment, a method is provided for adjusting an adjustable bra. The method includes engaging an adjustment mechanism. The adjustment mechanism is movable between a plurality of positions corresponding to the garment adjuster position of each garment feature and the adjustment mechanism includes a singular adjustment point configured to move the garment adjusters between different positions. The method also includes adjusting at least two of a plurality of garment adjusters based on the engagement of the adjustment mechanism.

In some embodiments, the adjusting at least two of a plurality of garment adjusters is achieved by an adjustment motor configured to move at least two features of the garment into the specific setting based on the adjustment position of the adjustment mechanism. In some embodiments, engaging the adjustment mechanism includes using at least one of voice, touch, and/or mobile device. In some embodiments, adjusting one or more of a plurality of garment adjusters is achieved by a knob configured to adjust at least two of the garment adjusters.

In some embodiments, the plurality of garment adjusters includes a cable mechanism inside of the garment in communication with the adjustment mechanism. In some embodiments, the at least one garment feature includes at least one of the waistband, the back straps, or the cup. In some embodiments, the adjustable bra is adjustable in an instance in which the bra garment is worn. In some embodiments, each adjustment position of the adjustment mechanism corresponds to a different activity for which the adjustable bra is used. In some embodiments, the adjustable bra also includes a plurality of layers and the cable mechanism is housed between at least two of the plurality of layers. In some embodiments, the cable mechanism is housed within a single layer of the bra garment.

The above summary is provided merely for purposes of summarizing some example embodiments to provide a basic understanding of some aspects of the disclosure. Accordingly, it will be appreciated that the above-described embodiments are merely examples and should not be construed to narrow the scope or spirit of the disclosure in any way. It will be appreciated that the scope of the disclosure encompasses many potential embodiments in addition to those here summarized, some of which will be further described below.

BRIEF DESCRIPTION OF THE DRAWINGS

Figure 1A:
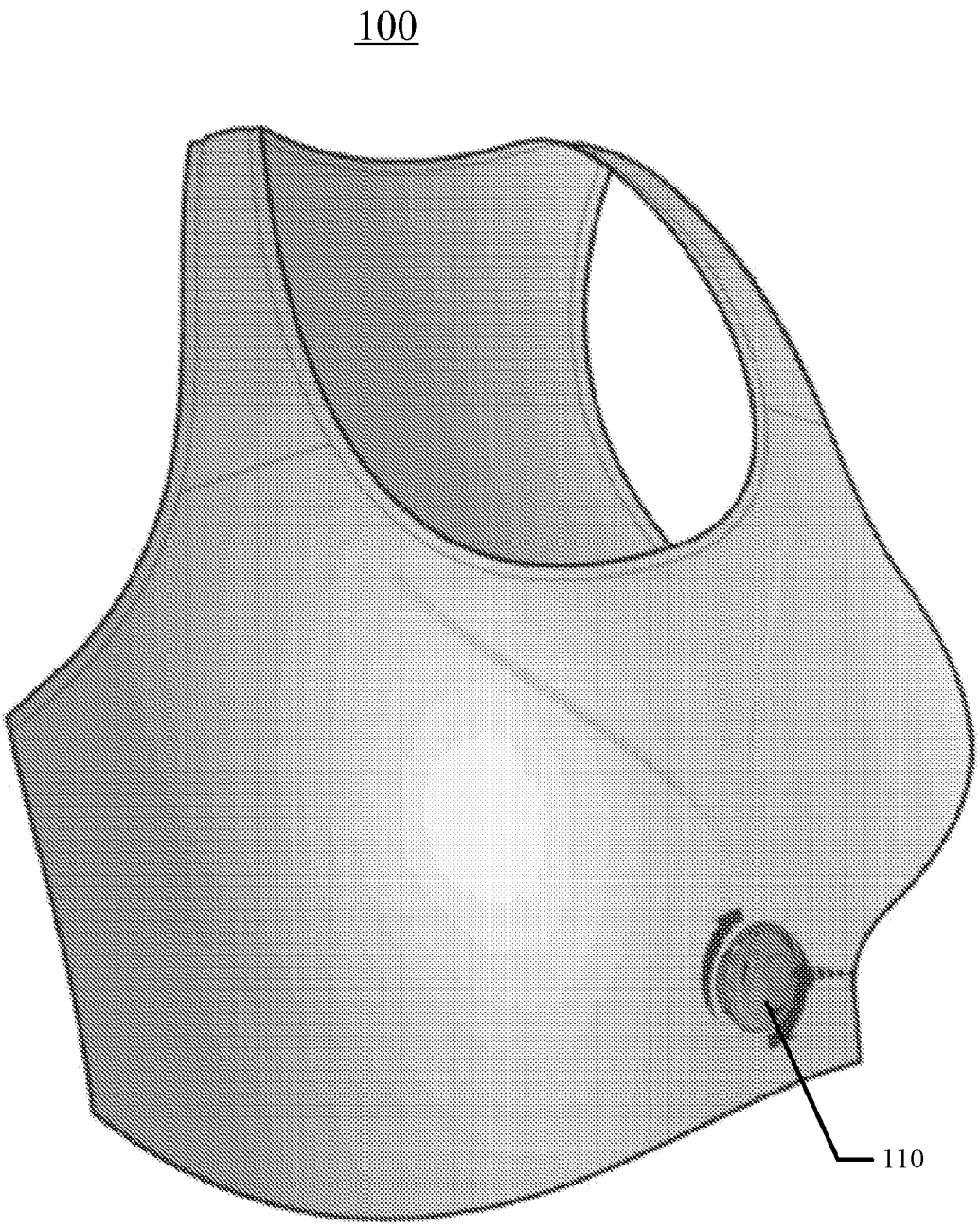
Figure 1B:
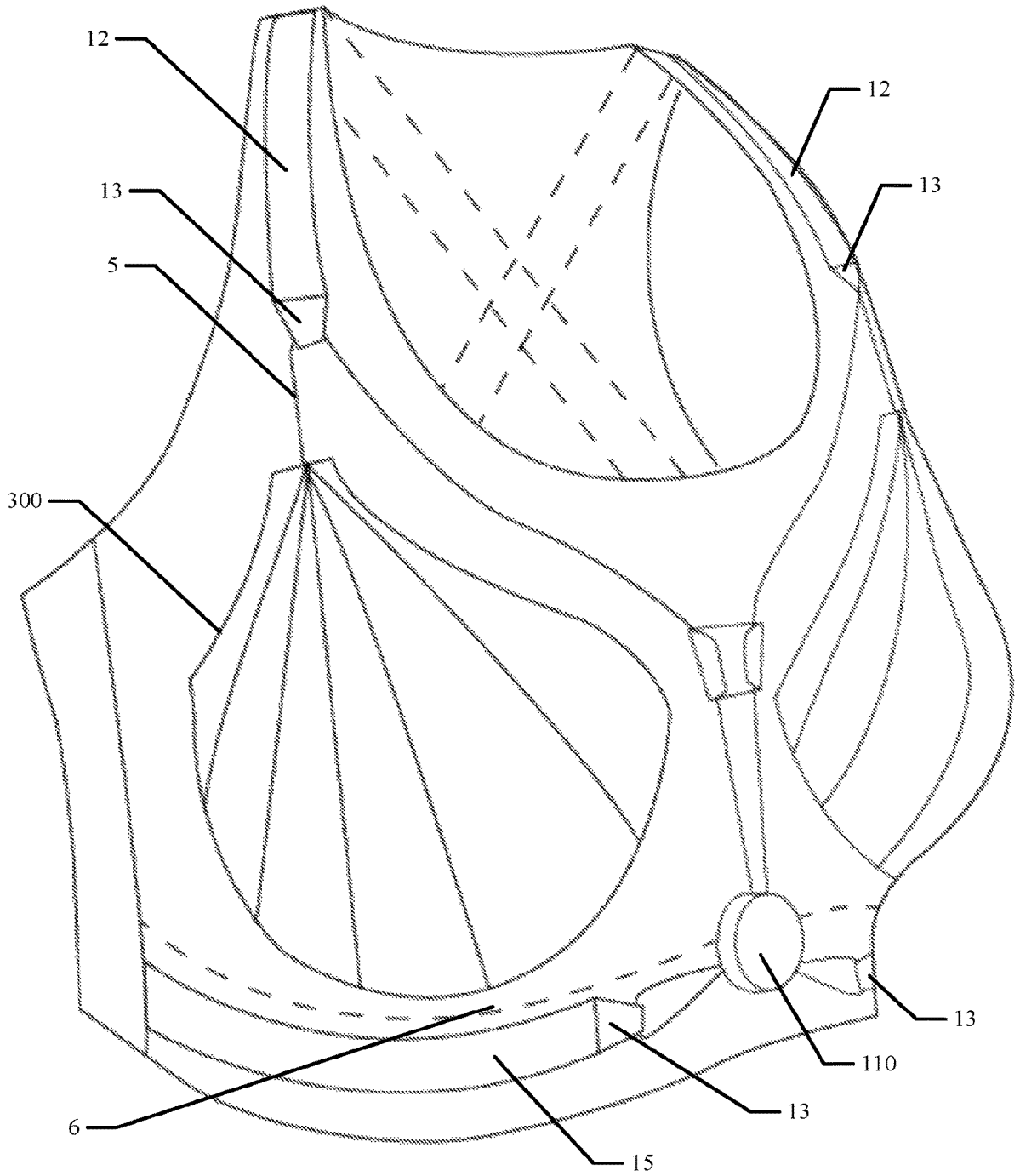
Figure 2:
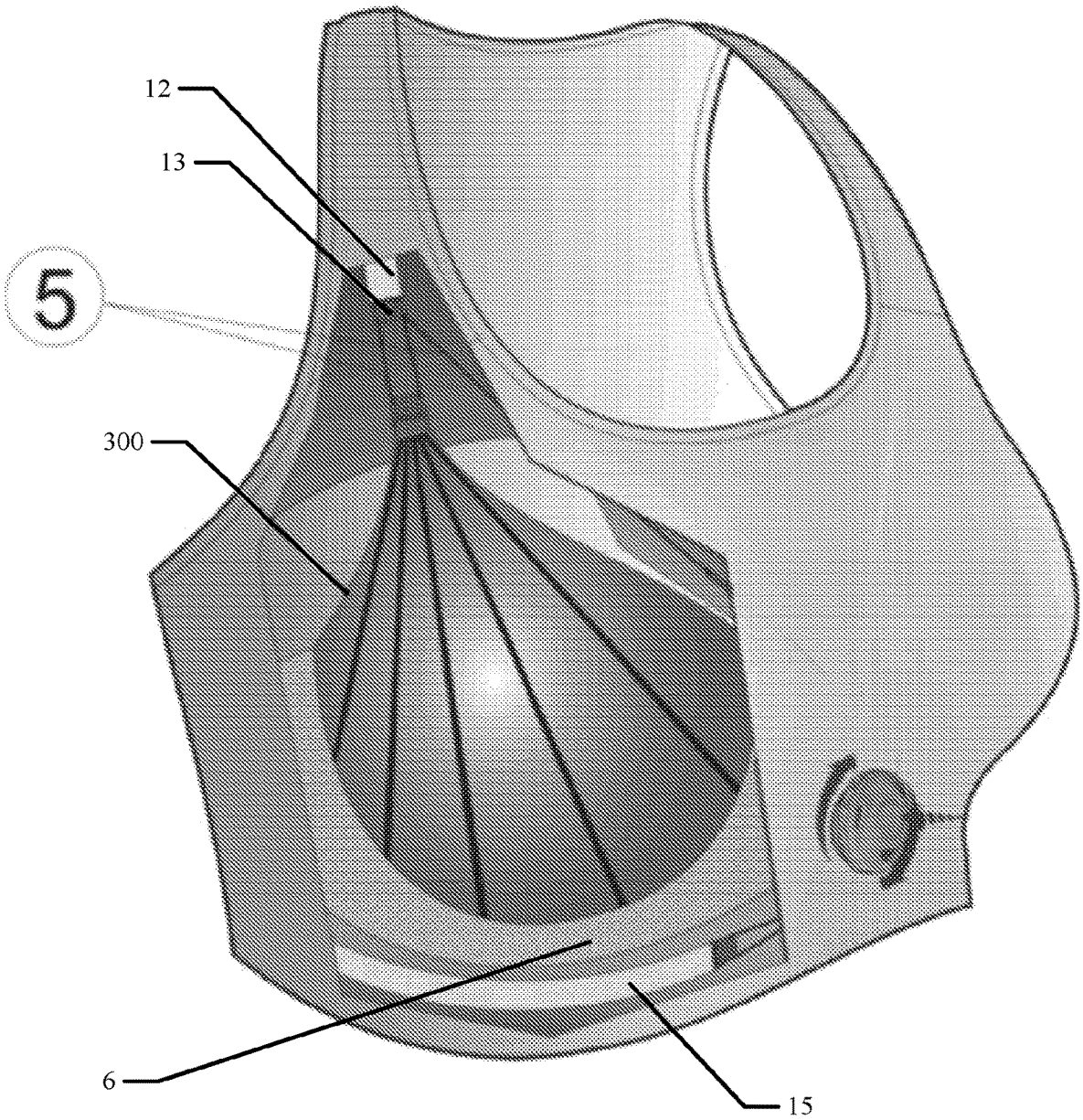
Figure 3A:
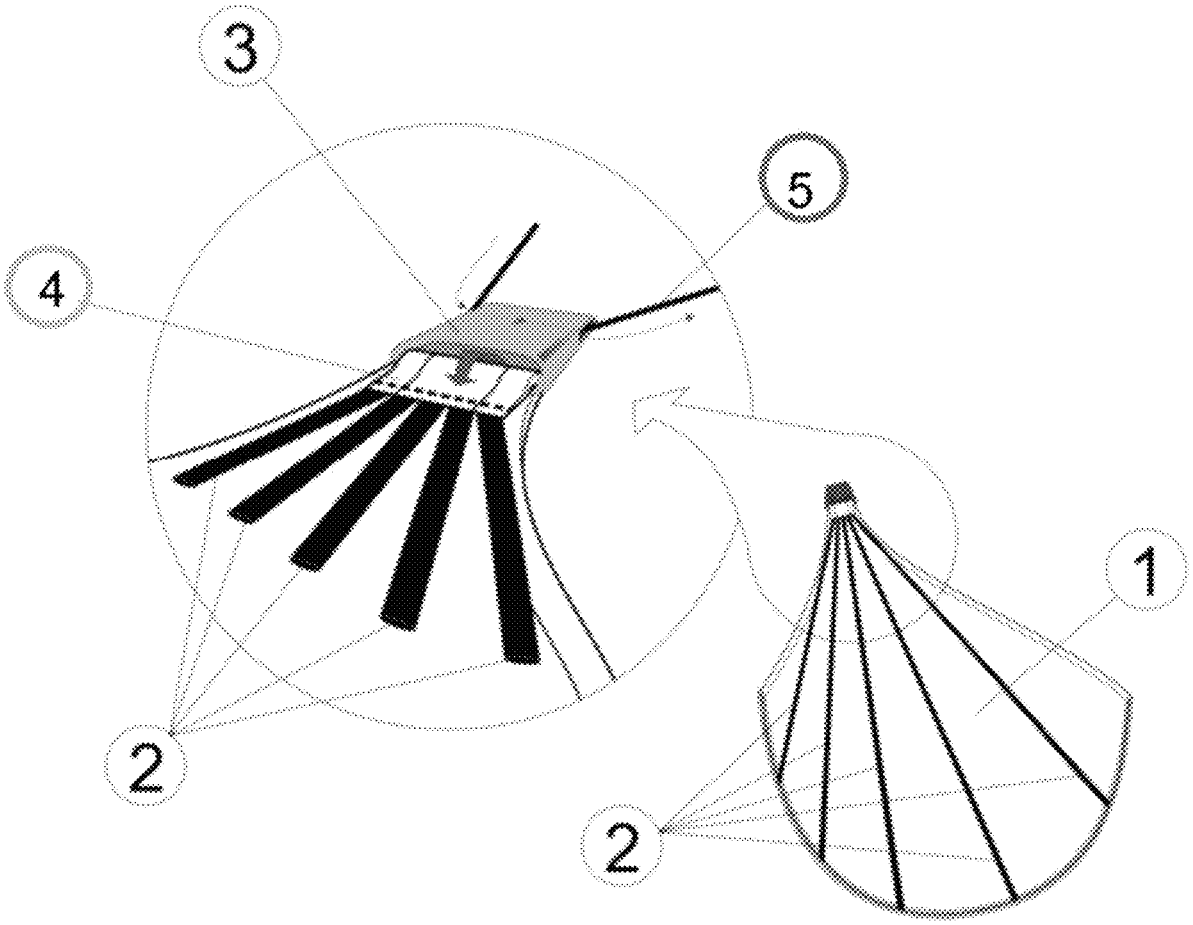
Figure 3B:
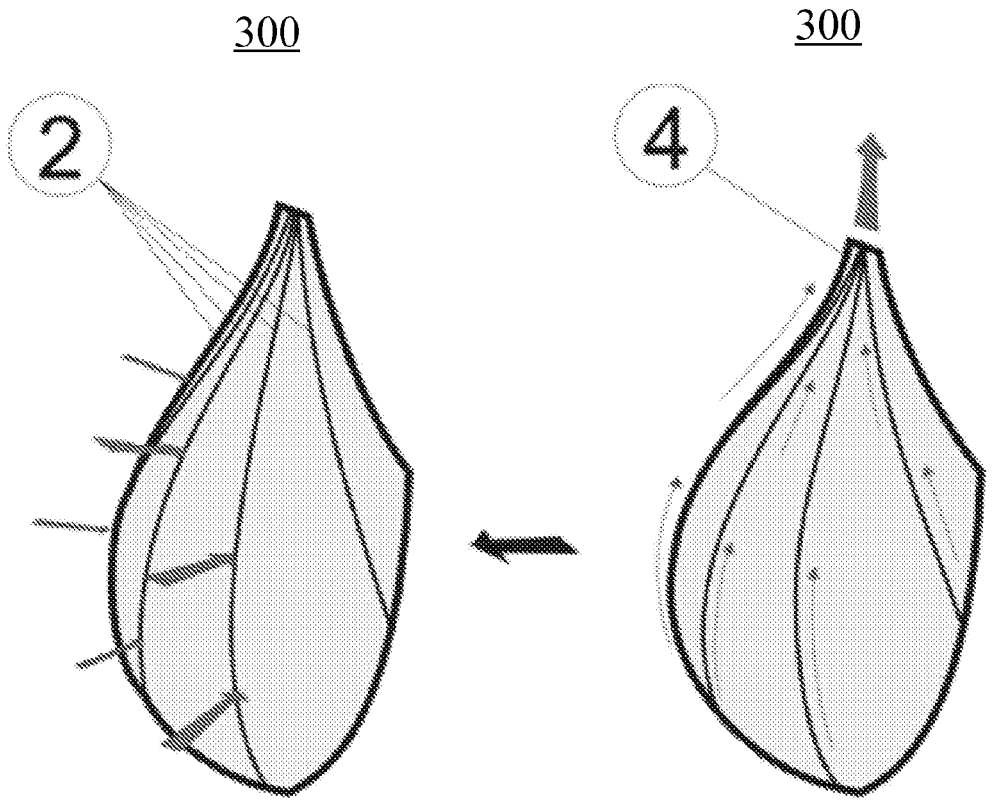
Figure 4:
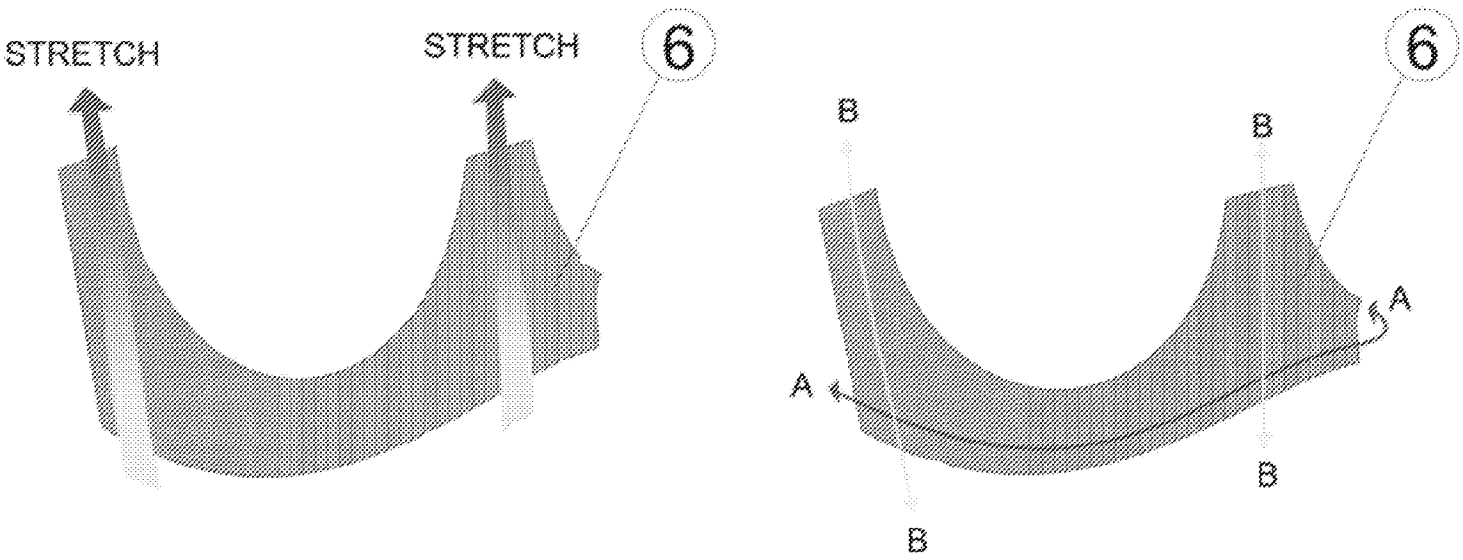
Figure 5:
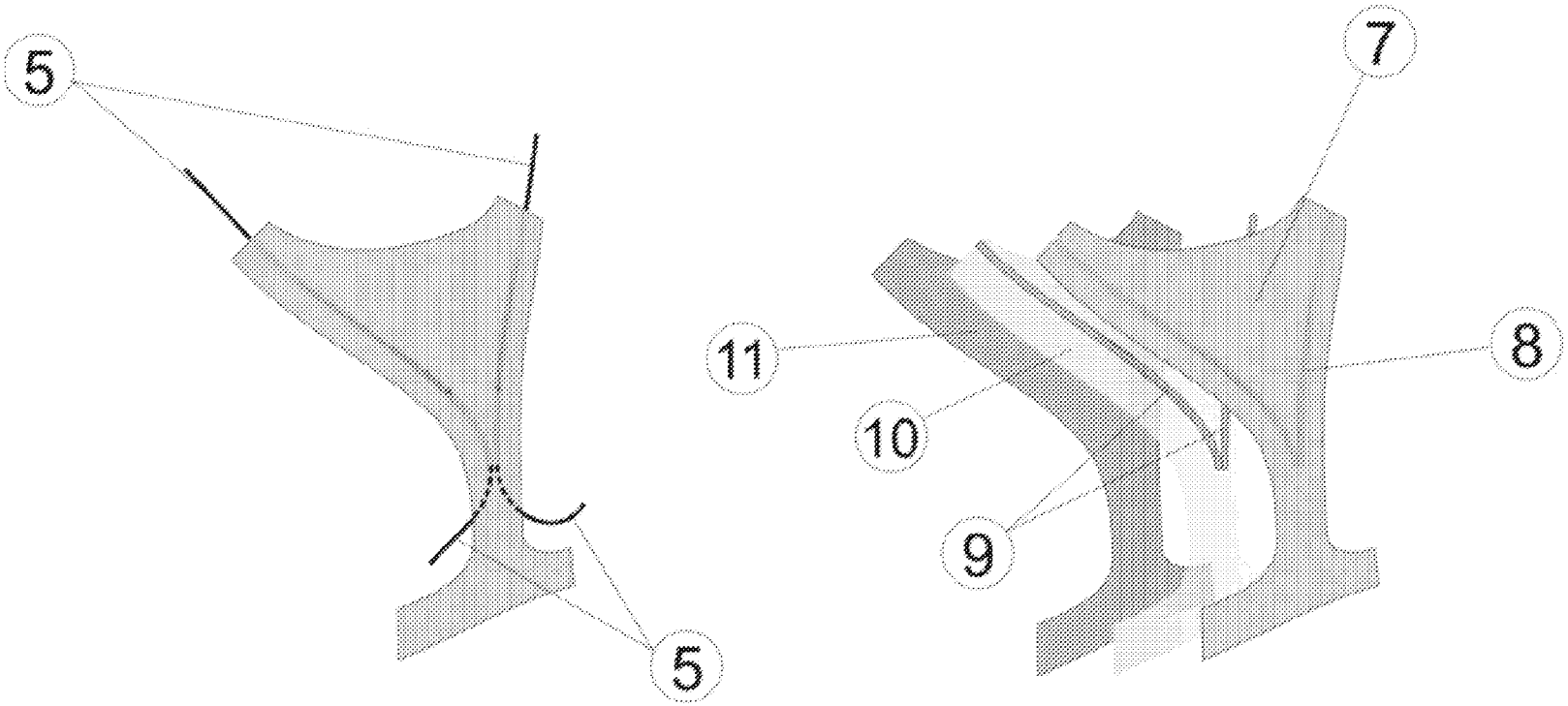
Figure 6:
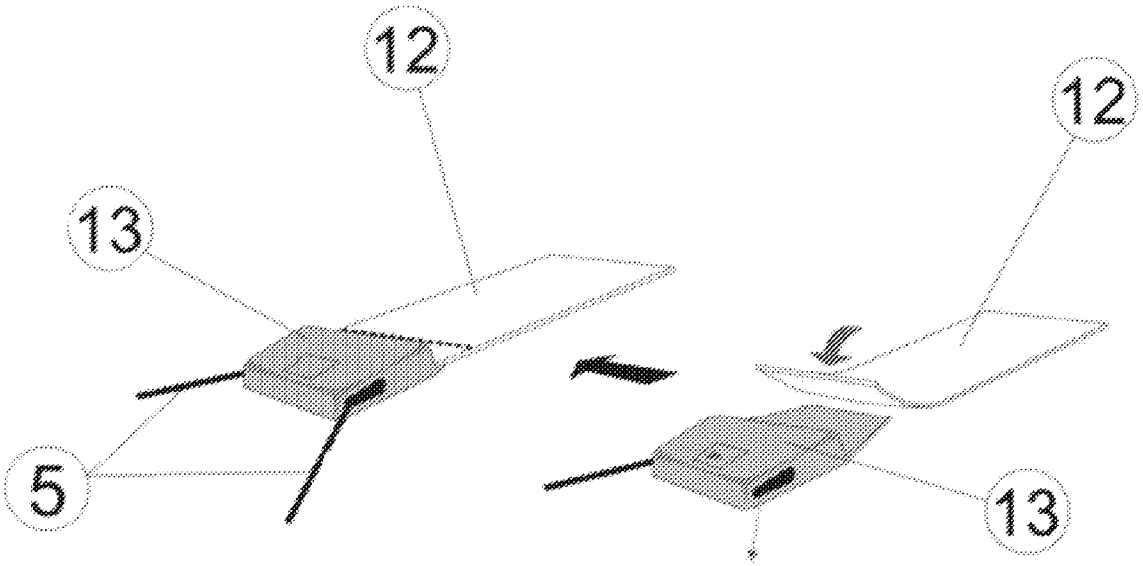
Figure 7A:
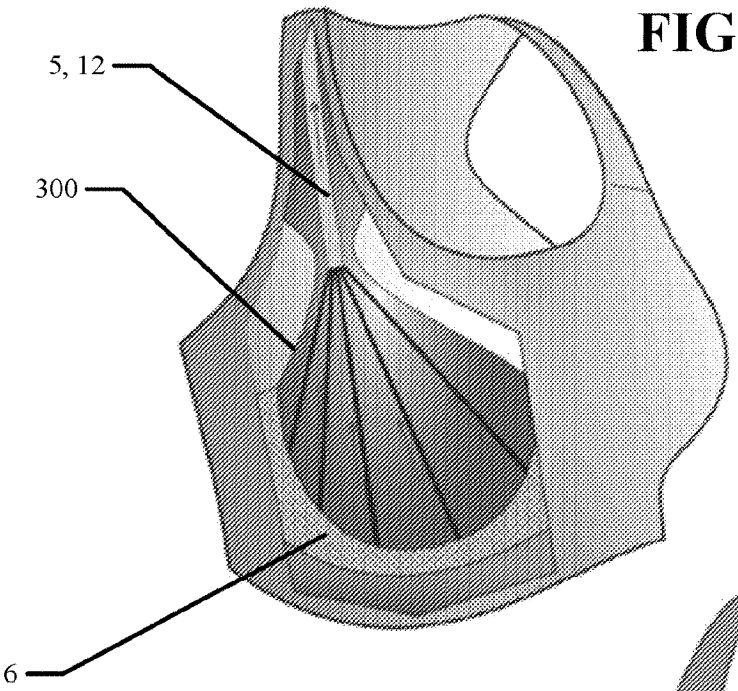
Figure 7B:
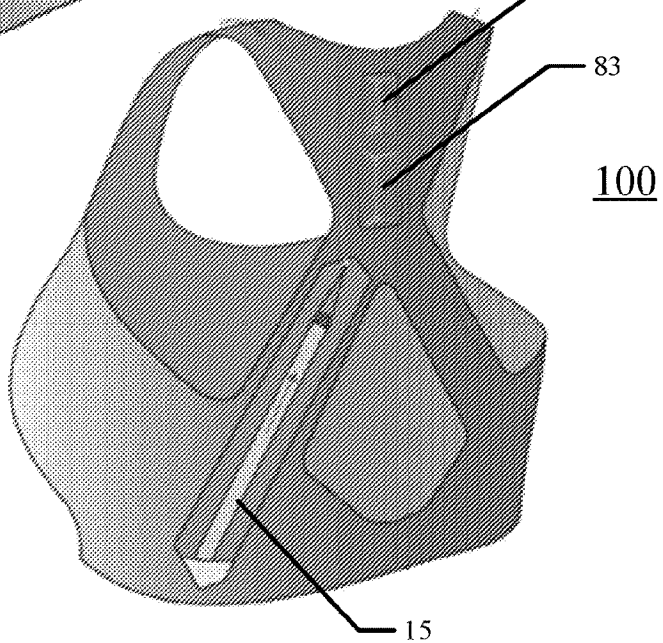
Figure 8:
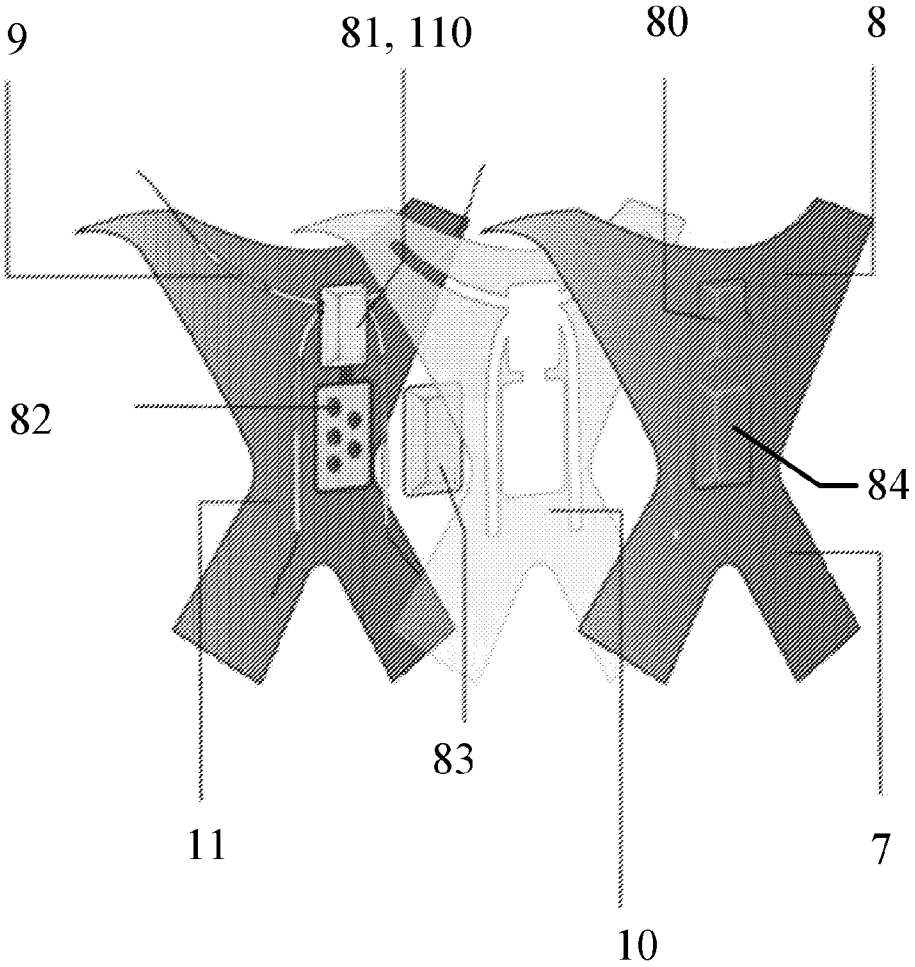

Having thus described certain example embodiments of the present disclosure in general terms, reference will hereinafter be made to the accompanying drawings, which are not necessarily drawn to scale, and wherein:

FIG. 1A illustrates an exterior view of an adjustable bra garment in accordance with an example embodiment;

FIG. 1B illustrates the inner workings of the adjustable bra garment in accordance with an example embodiment;

FIG. 2 illustrates a cut-away view of the adjustable bra garment in accordance with an example embodiment;

FIG. 3A illustrates the garment adjuster relating to a bra cup system in accordance with an example embodiment;

FIG. 3B illustrates the adjustment to the bra cup system in an instance in which the adjustment mechanism is activated in accordance with an example embodiment;

FIG. 4 illustrates a cradle of a bra garment in accordance with an example embodiment;

FIG. 5 illustrates a channeling system of a bra garment in accordance with an example embodiment;

FIG. 6 illustrates a linking system of a bra garment in accordance with an example embodiment;

FIG. 7A illustrates a cut-away frontal view of the adjustable bra garment in an instance the point of adjustment is in the back of the bra garment in accordance with an example embodiment;

FIG. 7B illustrates a cut-away rear view of the adjustable bra garment in an instance the point of adjustment is in the back of the bra garment in accordance with an example embodiment; and FIG. 8 illustrates a channeling system of a bra garment in an instance in which the point of adjustment is in the back of the bra garment in accordance with an example embodiment.

DETAILED DESCRIPTION

The present disclosure now will be described more fully hereinafter with reference to the accompanying drawings in which some but not all embodiments are shown. Indeed, these various embodiments of the disclosure may be embodied in many different forms and should not be construed as limited to the embodiments set forth herein; rather, these embodiments are provided so that this disclosure will satisfy applicable legal requirements. Like numbers refer to like elements throughout. As used herein, terms such as "front," "rear," "top," etc. are used for explanatory purposes in the examples provided below to describe the relative position of certain components or portions of components. Furthermore, as would be evident to one of ordinary skill in the art in light of the present disclosure, the terms "substantially" and "approximately" indicate that the referenced element or associated description is accurate to within applicable engineering tolerances.

The components illustrated in the figures represent components that may or may not be present in various embodiments of the disclosure described herein such that embodiments may include fewer or more components than those shown in the figures while not departing from the scope of the disclosure. Some components may be omitted from one or more figures or shown in dashed line for visibility of the underlying components.

The terminology used herein is for the purpose of describing particular embodiments only and is not intended to be limiting of the disclosure. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of the stated features, steps, operations, elements, and/or components, but do not prelude the presence or addition of one or more other features, steps, operations, elements, components, and/or groups thereof.

Unless otherwise defined, all terms (including technical and scientific terms) used herein have the same meaning as commonly understood by one having ordinary skill in the art to which this disclosure belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so denied herein.

The present disclosure is to be considered as an exemplification of the various embodiments and is not intended to limit the disclosure to the specific embodiments illustrated by the figures or description below. While various embodiments discussed herein are directed at an adjustable bra garment, the present disclosure may also apply to other garments.

Overview

The bra sizing system has been mostly the same since it was popularized around the 1950's and became the ultimate tool to finding the best fitting bra. However, the system has deficiencies as women's body and breasts are not the same from each person to person and even the two breasts of the same women differ in shape, volume, position, weight and other variations. Therefore, restricting sizing or shapes to a standard sizing chart makes finding the best fitting bra for a user almost impossible. Additionally, while traditional bras have various points of adjustment (e.g., a traditional bra may have one to four points of adjustment), these adjustments are typically independent from one another and therefore may be difficult to coordinate the proper adjustments for each point of adjustment. Various embodiments of the present disclosure provide for an adjustable bra garment (or any type of garment could use the same principles discussed herein) that allows the bra to be easily adjusted, even during use to allow for personalized fitting. The present disclosure allows for adjustable bras with a common adjustment point that is easily accessible to allow for simple adjustments to the bra garment using a cable system connected to various garment adjusters.

FIG. 1A illustrates an exterior view of an adjustable bra garment in accordance with the present disclosure. In various embodiments, the adjustable bra garment 100 may be configured in the shape of a traditional bra on the exterior, such that the adjustable features have little to no visibility outside of the adjustment mechanism 110 shown in FIG. 1A. As discussed herein, the adjustment mechanism 110 may be a knob or other type of input device, such that moving the adjustment mechanism 110 causes the bra garment 100 to be adjusted. For example, the adjustment mechanism 110 may include a knob configured to adjust at least two of the garment adjusters discussed herein. As described in various embodiments, the adjustment of the bra garment 100 may be made manually and/or automatically. For example, as shown in FIG. 1A, the adjustment mechanism 110 may be a knob configured to be rotated between different positions and adjust the bra accordingly. Additionally or alternatively, the bra garment may have one or more motors (e.g., motor 81 discussed in reference to FIGS. 7A-8) configured to automatically adjust the garment upon activation. In some embodiments, the motorized adjustment may be activated via at least one of voice direction, touch, and/or mobile device input. For example, the bra garment 100 may include a communication circuitry (e.g., Bluetooth, wi-fi, or the like) that allows the bra garment to be connected to a mobile device, such that a user may input a desired setting of the bra garment during use. In various embodiments with automatic adjustment functionality, one or more motors may be disposed within the bra garment, such that a given motor may adjust certain features of the bra garment. In various embodiments, the adjustment mechanism 110 may have various use modes preset, such that the bra garment 100 may be optimized for a given use. For example, a bra garment 100 may have a sports mode configured to adjust the bra such that the bra operates more similarly to a sports bra than a traditional bra.

FIG. 1B illustrates the inner workings of a bra garment in accordance with the present disclosure. As shown, the bra garment 100 may include various garment adjusters, such as two bra cup systems 300 (discussed in reference to FIGS. 3A and 3B below), a cradle 6 for each bra cup system 300, two shoulder straps 12, and an underarm strap 15. In various embodiments, the various garment adjusters may be in communication with the adjustment mechanism 110 via a string system 5 (e.g., the string 5 being received by the channeling system discussed in reference to FIG. 5 below). The various garment adjusters may be disposed below the outer fabric 7 (discussed in reference to FIG. 5 below), such that the garment adjusters have minimal visibility when worn by a user. FIG. 2 illustrates a cut-away view of another example bra garment 100 highlighting details of the connection between the bra cup system 300 and the shoulder strap 12 via the link system 13 discussed below. FIG. 2 illustrates the various components discussed in FIGS. 3A-6.

FIG. 3A illustrates a bra cup system 300 with a garment adjuster therein in accordance with an example embodiment. In an example embodiment, the bra cup system 300 may include a pre-molded cup 1, a plurality of bra cup bands 2, and a bra cup linkage 3. In some embodiments, the pre-molded cup 1 may be a pre-molded foam cup. In some embodiments, the cup 1 may be sized differently based on the size of the intended user.

In some embodiments, the plurality of bra cup bands 2 may be attached at the bottom edge of the bra cup 1 and attached to the bra cup linkage 3 at the other end of each band 2. In some embodiments, the bra cup bands 2 may be flat in shape, such that minimal or no impressions may be visible in an instance in which the bra garment is being worn. In some embodiments, the bands 2 may be less than 5 millimeters wide. In some embodiments, the bands 2 are spaced equally along the bra cup 1. In some embodiments, the bra cup system 300 may include five bra cup bands 2. In various embodiments, the number of bra cup bands may differ from one embodiment to another. For example, the number of bra cup bands 2 may increase in larger sized bra garments 100 and/or different variations of the adjustable bra discussed herein. In some embodiments, the length of each band 2 may be different, such that the tension on all of the bands are equal. In some embodiments, the bands 2 may converge at the cup apex 4. In some embodiments, the bands 2 may be attached (e.g., stitched) to the bra cup 1 at the cup apex 4. In some embodiments, the bra cup linkage 3 may be configured to connect the cup 1 and the string system 5, such that the bra cup linkage 3 provides minimal friction or resistance to the string 5 passing therethrough. In some embodiments, the bra linkage 3 may be sufficiently thin as to ensure smooth and unrestricted sliding within the bra garment 100. As such, the bra linkage 3 may be three millimeters or less.

FIG. 3B illustrates the functionality of the bra cup system in accordance with an example embodiment. As shown, in an instance in which the string system 5 is providing an upward force on the bra cup linkage 3 and subsequently the cup apex 4, the bra cup bands 2 may be configured to contract inwardly to change the fit of the bra. In some embodiments, as the cup 1 gets stretched upward from the cup apex (4), the elastic bands 2 that are contoured over the curvature of the cup may be stretched sequentially and the tension in the elastic bands 2 may start pushing against the bra cup 1 causing a compression of the cup inwards (e.g., thus enabling breast compression).

FIG. 4 illustrates an adjustable cradle configured for use in accordance with the present disclosure. As shown in FIG. 2, the cradle 6 may be positioned below the bra cup 1. In an example embodiment, the cradle 6 may be made out of a material configured to have minimal stretching in the horizontal direction (e.g., along the A-A direction), such that the cradle 6 provides a firm fit on a user's body for maximum support and stability. In some embodiments, the cradle 6 may be made out of a material configured to allow for stretching of the cradle in the vertical direction (e.g., along the B-B direction). In various embodiments, in an instance the cradle 6 is stretched in the upward direction, the cradle 6 may push up the bra cup 1 (e.g., thus enabling breast lift). In various embodiments, the cradle 6 may be formed out of one or more stretch fabrics, such as a knitted polyester, spandex, and/or nylon. In some embodiments, the cradle 6 may formed out of one or more rigid stabilizing fabrics, such as a woven polyester and/or spandex. In some embodiments, the cradle 6 may be formed out of a mixture of stretch fabric and rigid stabilizing fabrics.

FIG. 5 illustrates the channeling system of an example adjustable bra garment in accordance with the present disclosure. As shown, the channeling system may be made of an outer fabric layer 7 onto which a groove 8 is provided. For example, the groove 8 may be provided on the inner side of the outer fabric layer 7 by means of fabric molding. In some embodiments, the groove 8 may be configured to receive a tube 9 (e.g., a specially designed plastic tube). In an example embodiment, the tube 9 may be 2.5 millimeters or less in diameter. In some embodiments, the tube 9 may be disposed in the groove 8. In some embodiments, the inner fabric layer 11 may be attached to the inner side of the outer fabric layer 7 (e.g., using a glue film 10). As such, the outer fabric layer 7 and the inner fabric layer 11 may hold the tube 9 within the groove 8. In some embodiments, the string 5 discussed herein may be disposed within the tube 9, such that a channel is created to allow for the string 5 to pass through the channel with minimum resistance.

In various embodiments, the channeling system may be used in adjustable garments (e.g., an adjustable bra garment) such that the string system 5 may travel over the contoured shape of the human body with minimal resistance. Additionally, the channeling system may provide additional garment stability (e.g., additional stability to the center front portion of the bra by preventing unwanted bunching of strings and/or material when tension is applied to the string system). In various embodiments, the channeling system may be disposed within a single layer of a bra garment. For example, a layer of the garment may be made out of an engineered knit technology that allows for the cable mechanism to be incorporated within one single layer of the bra garment.

FIG. 6 illustrates the link system of an example embodiment used to connect the string system 5 to the shoulder straps 12. In various embodiments, the link system 13 may be configured to allow the string 5 to pass through (e.g., connecting the cup system at one end and the adjustment mechanism at the other). In various embodiments, the link system 13 may allow for the adjustment mechanism to simultaneously adjust both the shoulder strap 12 and the bra cup 1 (e.g., via the bands 2). As such, the link system 13 may be attached to the shoulder strap 12 at one end and provide a passthrough for the string 5 at or near the other end of the link system 13. In various embodiments, the link system 13 may be provided at the end of both shoulder straps 12 of the bra garment. In various embodiments, as shown in FIG. 1B, the link system 13 may also be used for other garment adjusters (e.g., to adjust the underarm strap 15). Additionally, in larger sized bra garment, the link system 13 may be implemented in various other positions on a bra garment 100 based on changes in load, frictional forces, and bra proportions. For example, some embodiments of the bra garment 100 may include miniaturized moving components to further reduce friction and resistance to allow for the entire system work smoother and more efficiently. Additionally, various other linkages may be used to carry out adjustments via the adjustment mechanism 110.

As discussed herein, the adjustment mechanism may be configured to be adjust various garment adjusters relating to different bra garment features. For example, the string system 5 may connect the adjustment mechanism 110 to the shoulder straps 12, the bra cup system 300, and/or the underarm strap 15, such that one or more of the shoulder straps 12, the bra cup system 300, and the underarm strap 15 are adjusted based on the engagement of the adjustment mechanism 110. In various embodiments, the adjustment mechanism 110 may be a singular adjustment point for multiple garment adjusters. Additionally, the adjustment mechanism 110 may include one or more adjustment motors configured to automatically adjust at least two garment adjusters upon engagement of the adjustment mechanism 110.

FIGS. 7A and 7B illustrate the functionality of the bra garment 100 in accordance with an example embodiment in an instance in which the adjustment mechanism 110 is located in the back of the bra garment. In various embodiments, the adjustment mechanism 110 may include a motor 81 and battery 83 (discussed in reference to FIG. 8). As shown, the adjustment mechanism 110 may be a singular adjustment point (e.g., on the rear of the bra garment 100). In some embodiments, as shown, the adjustment mechanism 110 may be a motor 81 configured to move an example string system 5, such as the string system 5 discussed herein. In some embodiments, the motor 81 may be connected to a knob or the like to allow for a user to manually adjust the knob to activate the motor in order to adjust the bra garment. In some embodiments, the adjustment mechanism 110 may be a manual adjustment, such as the one shown in FIGS. 1 and 2, at the location of the motor shown in FIG. 7B.

As shown in FIGS. 7A and 7B, the string system 5 may be connected to the configured to move in such a way to adjust the components of the bra garment as discussed in reference to FIGS. 1-6. For example, the movement of the motor 81 may cause the string system 5 to either increase or decrease the upward force on the bra cup system in an instance in which the motor is activated (e.g., by a user).

FIG. 8 illustrates the channeling system of an example adjustable bra garment in an instance in which the adjustment mechanism 110 is in the rear of the bra garment. Similar to FIG. 5 discussed above, the channeling system may be made of an outer fabric layer 7 onto which a groove 8 is provided. For example, the groove 8 may be provided on the inner side of the outer fabric layer 7 by means of fabric molding. In some embodiments, the groove 8 may be configured to receive a tube 9 (e.g., a specially designed plastic tube). In an example embodiment, the tube 9 may be 2.5 millimeters or less in diameter. In some embodiments, the tube 9 may be disposed in the groove 8. In some embodiments, the outer fabric layer 7 may also define a channel to receive the adjustment mechanism 110 and any associated components. For example, the outer fabric layer 7 may define a motor cavity 80, a battery cavity 84, or the like. In some embodiments, the inner fabric layer 11 may be attached to the inner side of the outer fabric layer 7 (e.g., using a glue film 10). As such, the outer fabric layer 7 and the inner fabric layer 11 may hold the tube 9 within the groove 8, the motor 81 within the motor cavity 80, and/or the battery 83 and battery harness 82 within the battery cavity 84 (e.g., the battery 83 and the battery harness 82 snap together and then are disposed within the battery cavity). In some embodiments, the string 5 discussed herein may be disposed within the tube 9, such that a channel is created to allow for the string 5 to pass through the channel with minimum resistance. Various other cavities may be created (e.g., by fabric molding) to provide for a cavity to house various other components between the outer fabric layer 7 and the inner fabric layer 11.

While the adjustment mechanism 110 including the motor 81 and the battery 83 are shown in an instance in which the adjustment mechanism 110 is in the rear of the bra garment, various other locations for the motor 110 and/or the battery may be contemplated in an instance in which a motor 81 is included as an adjustment mechanism. In some embodiments, an adjustment mechanism 110 may include a manual adjuster, such as the knob shown in FIG. 1, to work in conjunction and/or in place of the motor 81. For example, a manual adjuster may be in communication with the motor 81, such that the movement of the manual adjuster may activate the motor 81. Alternatively, the manual adjuster may work as shown in FIGS. 1-6, such that the movement of the manual adjuster may activate the string system 5 independent of any motor 81 operation.

In various embodiments, the channeling system may be used in adjustable garments (e.g., an adjustable bra garment) such that the string system 5 may travel over the contoured shape of the human body with minimal resistance. Additionally, the channeling system may provide additional garment stability (e.g., additional stability to the center front portion of the bra by preventing unwanted bunching of strings and/or material when tension is applied to the string system).

Although the various embodiments have been illustrated and described herein with reference to preferred embodiments and specific examples thereof, it will be clear to those of ordinary skill in the art that other embodiments and examples may perform similar functions and/or achieve like results. All such equivalent embodiments and examples are within the spirit and scope of the present disclosure, are contemplated thereby, and are intended to be covered by the following claims.

Many modifications and other embodiments set forth herein will come to mind to one skilled in the art to which these disclosures pertain having the benefit of the teachings presented in the foregoing descriptions and the associated drawings. Therefore, it is to be understood that the disclosures are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

That which is claimed:

1. An adjustable bra, the adjustable bra comprising:

a bra garment comprising two shoulder straps, an underarm strap, and at least one bra cup system, wherein the at least one bra cup system comprises a pre-molded cup, a plurality of bra cup bands, and a bra cup linkage, the plurality of bra cup bands each attached to a bottom edge of the pre-molded cup at a first end and attached to the bra cup linkage at a second end, wherein each shoulder strap of the two shoulder straps comprises a respective link system, the adjustable bra further comprising an adjustment mechanism; and a string system comprising at least one string, the at least one string coupled to each of the respective link system, the bra cup linkage, and the adjustment mechanism such that adjustment of a position of the adjustment mechanism causes an adjustment of the at least one bra cup system and the shoulder strap.

2. The adjustable bra of claim 1, further comprising an adjustment motor configured to cause adjustment of the position of the adjustment mechanism.

3. The adjustable bra of claim 2, wherein the adjustment motor is activated by at least one of voice, touch, and/or mobile device.

4. The adjustable bra of claim 1, wherein the plurality of bra cup bands are configured such that tension on each cup band of the plurality of bra cup bands is substantially equal.

5. The adjustable bra of claim 1, further comprising a channeling system comprising (a) a groove provided on an inner surface of an outer fabric of the adjustable bra and (b) a tube, the groove configured to receive the tube therein.

6. The adjustable bra of claim 5, wherein the at least one string is disposed at least in part within the tube.

7. The adjustable bra of claim 5, wherein the bra garment further comprises a plurality of layers, the plurality of layers including the outer fabric, wherein the channeling system is housed between at least two of the plurality of layers.

8. The adjustable bra of claim 5, wherein the channeling system is housed within a single layer of the bra garment.

9. The adjustable bra of claim 1, wherein the bra garment is adjustable in an instance in which the bra garment is worn.

10. The adjustable bra of claim 1, wherein the adjustment mechanism defines a plurality of adjustment positions and each adjustment position corresponds to a different activity for which the adjustable bra is used.

11. A method of adjusting an adjustable bra, the method comprising:

providing the adjustable bra, the adjustable bra comprising:

a bra garment comprising two shoulder straps, an underarm strap, and at least one bra cup system, wherein the at least one bra cup system comprises a pre-molded cup, a plurality of bra cup bands, and a bra cup linkage, the plurality of bra cup bands each attached to a bottom edge of the pre-molded cup at a first end and attached to the bra cup linkage at a second end, wherein each shoulder strap of the two shoulder straps comprises a respective link system, the adjustable bra further comprising an adjustment mechanism; and a string system comprising at least one string, the at least one string coupled to each of the respective link system, the bra cup linkage, and the adjustment mechanism; and engaging the adjustment mechanism such that a position of the adjustment mechanism is adjusted, which causes an adjustment of the at least one bra cup system and the shoulder strap.

12. The method of claim 11, wherein the adjusting of the adjustment mechanism is achieved by an adjustment motor configured to adjust tension of the at least one string.

13. The method of claim 12, wherein engaging the adjustment mechanism comprises using at least one of voice, touch, and/or mobile device.

14. The method of claim 11, wherein the plurality of bra cup bands are configured such that tension on each cup band of the plurality of bra cup bands is substantially equal.

15. The method of claim 11, further comprising a channeling system comprising (a) a groove provided on an inner surface of an outer fabric of the adjustable bra and (b) a tube, the groove configured to receive the tube therein.

16. The method of claim 15, wherein the at least one string is disposed at least in part within the tube.

17. The method of claim 15, wherein the bra garment further comprises a plurality of layers, the plurality of layers including the outer fabric, wherein the channeling system is housed between at least two of the plurality of layers.

18. The method of claim 15, wherein the channeling system is housed within a single layer of the bra garment.

19. The method of claim 11, wherein the adjustable bra is adjustable in an instance in which the bra garment is worn.

20. The method of claim 11, wherein each adjustment position of the adjustment mechanism defines a plurality of adjustment positions and each adjustment position corresponds to a different activity for which the adjustable bra is used.

* * * * *